US005264001A

United States Patent [19]

Arifoglu et al.

[11] Patent Number: 5,264,001

[45] Date of Patent: * Nov. 23, 1993

[54] SEQUENTIAL OXIDATIVE/REDUCTIVE BLEACHING AND DYEING IN A MULTI-COMPONENT SINGLE LIQUOR SYSTEM

[75] Inventors: Mustafa Arifoglu, Wyndmore; William N. Marmer, Ft. Washington, both of Pa.

[73] Assignee: The United States of America as represented by the Secretary of Agriculture, Washington, D.C.

[ * ] Notice: The portion of the term of this patent subsequent to Oct. 9, 2007 has been disclaimed.

[21] Appl. No.: 697,549

[22] Filed: May 9, 1991

Related U.S. Application Data

[60] Continuation-in-part of Ser. No. 552,381, Jul. 13, 1990, Pat. No. 5,103,522, which is a division of Ser. No. 299,174, Jan. 19, 1989, Pat. No. 4,961,752.

[51] Int. Cl.[5] ..... D06L 3/02; D06L 3/00; D06M 11/00; D06M 13/322

[52] U.S. Cl. ..... 8/111; 8/110; 8/128.1

[58] Field of Search ..... 8/110, 111, 128.1, 188.1, 8/188.2

[56] References Cited

U.S. PATENT DOCUMENTS

| | | | |
|---|---|---|---|
| 2,914,374 | 11/1959 | Harris et al. | 8/111 |
| 4,961,752 | 10/1990 | Arifoglu et al. | 8/111 |
| 5,103,522 | 4/1992 | Arifoglu et al. | 8/111 |

FOREIGN PATENT DOCUMENTS

| | | |
|---|---|---|
| 3149978 | 6/1983 | Fed. Rep. of Germany . |
| 3433926 | 3/1986 | Fed. Rep. of Germany . |
| 48-20975 | 3/1973 | Japan . |
| 48-61782 | 8/1973 | Japan . |
| 51-64082 | 3/1976 | Japan . |
| 55-152800 | 11/1980 | Japan . |
| 57-89661 | 6/1982 | Japan . |
| 57-128766 | 8/1982 | Japan . |
| 59-22821 | 5/1984 | Japan . |

OTHER PUBLICATIONS

Bereck et al., *Textil Praxis International*, vol. 37, No. 6, Jun. 1982, pp. 621–629.

Arifoglu et al., *Textile Research Journal*, vol. 60, No. 6, Jun. 1990, pp. 319–328.

"New Lecture on Dyeing Processing, No. 5–Purification and Bleaching" edited by Shozo Asahara, published by Kyoritsu Shuppan K.K. on May 15, 1972, pp. 12–15.

*Primary Examiner*—Anthony McFarlane
*Assistant Examiner*—Nhat D. Phan
*Attorney, Agent, or Firm*—M. Howard Silverstein; John D. Fado; Gail E. Poulos

[57] ABSTRACT

The present invention is drawn to new processes for sequential oxidative and reductive bleaching and dyeing of fibers (e.g. natural, synthetic, or blends thereof) e.g. in a single bath, which provide superior bleaching with less physical damage and therefore improved dyeing. Said processes comprising the steps of: (1) bleaching fibers with hydrogen peroxide; (2) adding either, (a) a material which combines with hydrogen peroxide to form a reductive bleaching agent, or (b) an inactivating material to inactivate unspent hydrogen peroxide with subsequent addition of a reductive bleaching agent; (3) reductively bleaching the already oxidatively bleached fibers; (4) adding an oxidizing material in an amount at least sufficient to oxide excess reductive bleaching agent; and (5) dyeing of the bleached fibers. Also encompassed by the present invention are novel bleached and dyed fibers produced by the aforementioned processes, having highly advantageous and desirable properties.

20 Claims, 10 Drawing Sheets

SEQUENTIAL OXIDATIVE/REDUCTIVE BLEACHING AND DYEING IN A MULTI-COMPONENT SINGLE LIQUOR SYSTEM

CROSS-REFERENCE TO RELATED APPLICATIONS

The present application is a continuation-in-part of application Ser. No. 07/552,381 filed Jul. 13, 1990, now U.S. Pat. No. 5,103,522 issued Apr. 14, 1992, which is a division of application Ser. No. 07/299,174 filed Jan. 19, 1989, now U.S. Pat. No. 4,961,752 issued Oct. 9, 1990: both of the foregoing applications are by Mustafa Arifoglu and William Marmer and are entitled "Sequential Oxidative and Reductive Bleaching in a Multicomponent Single Liquor System".

FIELD OF THE INVENTION

The present invention relates to: processes including oxidative bleaching (using hydrogen peroxide), reductive bleaching, and dyeing of fibers, which may be carried out in a single bath, and; fibers bleached and dyed by the aforementioned processes.

BACKGROUND AND SUMMARY OF THE INVENTION

German Offenlegungsschrift 3,433,926 (Mar. 27, 1986) to Streit et al, discloses a single bath reductive and oxidative bleaching process, in which the reductive bleaching with thiourea dioxide precedes an oxidative hydrogen peroxide bleaching, whereas in the processes of the present invention the reductive bleaching is subsequent to the oxidative bleaching and dyeing may be carried out in the same bath. Japanese patent 51-64082 (Jun. 3, 1976) is drawn to a process in which hydrogen peroxide and thiourea are mixed at-the start of the bleaching processes (i.e., bleaching with a single mixture which contains both hydrogen peroxide and thiourea), while by contrast the instant invention utilizes separate steps of oxidative bleaching followed by reductive bleaching and dyeing. It has unexpectedly and surprisingly been discovered that the processes of the present invention provide greatly improved results (including, a higher Whiteness Index, lower Yellowness Index, lower degree of damage, and improved dyeing) as compared to the results achieved by separate dyeing following either of the aforementioned prior art bleaching processes.

Scoured wool varies in shade from the light cream of wools considered to have good color to discolored urine-stained wools and the near blacks of heavily pigmented wool. Since even the background natural color of wool interferes with dyeing to specific pastel or bright colors, bleaching is practiced on all of these wools for such purposes. Therefore, in order to achieve bright shades, one has to either bleach wool prior to dyeing or incorporate a bleaching agent sometime during the dyeing cycle. The former process calls for a lengthy treatment, since wool has to be bleached and free of any residual bleaching agent before it may be successfully dyed. The latter process, though sounding promising, must take into account the sensitivity of some dyes toward bleaching agents, hence limiting the number of dyes that may be used. Two main factors will be operating in the dyeing of bleached fibers. These are the swelling of fibers, which results from disulfide scission caused by bleaching treatments, and the creation of negative charges on the surface, which may hinder dye adsorption and diffusion. As these factors work against each other, a compromise has to be found where there is sufficient swelling caused by bleaching but at the same time considerably less negative charge created at the surface. This should be achievable by reducing the concentration of bleaching reagents and limiting the severity of the bleaching conditions so that the factors above are maintained within limits to allow an acceptable dyed product. It is also known that the higher the concentration of bleaching agents and the more severe the bleaching conditions are, the greater the whiteness. Therefore a balance must be achieved between optimum whiteness and good quality dyeing. Lemin et al (Some physicochemical properties of damaged wools, J. Soc. Dyers Colour. 62, 129–144 (1946)) reported that hydrogen peroxide-bleached wool dyed to a weaker shade than did unbleached wool, because both dye affinity and the number of dye sites available were reduced from unbleached wool. Duffield, "Dyeing for machine washable fabrics", Proceedings of Wool in the Eighties Seminar, Wakefield, Mass., April 1984, pp. 173–174 reported the "Tubotex PC$^2$" (mixture of sodium silicate and caustic soda with pH 9.0–10.0) prebleaching process; bright pastel shades from subsequent dyeing are fostered by this rapid, low temperature alkaline hydrogen peroxide bleaching (1 hour; 40° C.; pH 9.0–10.0 using sodium silicate and caustic soda). This process has been used in several bleaching houses with improved results in terms of whiteness and residual fiber damage, owing to the low temperature of the bleaching process.

There are numerous scientific papers and patents on the simultaneous dyeing and bleaching of fibers (see e.g. Anonymous (to Ciba-Geigy Co.), Simultaneous dyeing and bleaching fibres, Swiss Patent 63-14,624 (Nov. 29, 1963); Arsov, A., Kunchev, E., Serafimov, S., Single bath bleaching and dyeing of wool by acid azo dyes, Tekst. Prom. (Sofia), 19(10), 29–32 (1970), CA 75(4)22318k; BASF A.G., Technical Leaflet M5756e (1981); Duffield, P. A., Review of Wool Bleaching, IWS Technical Information Bulletin, 31–33 (1986); Nikolova, A., Arsov, A., Kunchev, E., Medyalkova, K., Single bath dyeing and bleaching of mixed wool-artificial fibre yarn, Tekst. Prom. (Sofia), 21(4), 193–196 (1972), CA 81(14)79197y; Schmidt, O., Simultaneous dyeing and bleaching of proteinaceous fibrous material, U.S. Pat. No. 3,551,087 (Dec. 29, 1970); Schmidt, O., Simultaneous dyeing and bleaching of wool, German Patent 1,469,609 (2/26/1970); Schmidt, O., Procedure to bleach and to dye protein-containing fibres in a single bath, Belgian Patent 672,398 (May 16, 1966); Senner, P., Ulmer, D., Renner, J., Possibilities of single bath dyeing and bleaching of wool, Z. Gesamte Textilind., 68(10), 763–767 (1966), 68(11), 858–863 (1966); Uehara, N., Dyeing and bleaching of fibers, Japanese Patent 73 20,975 (Mar. 15, 1973); and Uehara, N., Single bath bleaching and dyeing of textiles, Japanese Patent 73 61,782 (Aug. 29, 1973)). Schmidt supra, reported simultaneous dyeing and bleaching of proteinaceous and other fibers, where the fibers are treated at elevated temperatures in a non-alkaline aqueous liquor that contains (a) an acid dye capable of dyeing wool and resistant to peroxides, and (b) performic acid in the form of the reaction product of hydrogen peroxide and a performic acid precursor. Senner et al supra, reported performic acid with a special stabilizer, and hydrogen peroxide with the stabilizer Lufibrol W as being very efficient bleaching agents in the single bath dyeing and bleaching of wool. Arsov et al supra, reported a satisfactory dyeing and bleaching process of wool yarn in which the yarn is first dyed and then a solution containing hydrogen peroxide is added near the end of the dyeing to give bright shades. Nikolova et al supra, reported a single bath dyeing and bleaching process of a 50:50 rayon-wool yarn in which the hydrogen peroxide is added to the dyebath after 20 minutes at the boil to obtain greater color purity and brilliance than yarn processed in the conventional two-bath method. Even though these processes are claimed to give bright shades they are rather limited in the sense that some of the dyes are sensitive to bleaching agents and hence cannot be used. Uehara (Japan ('975)) supra, reports a single bath bleaching and dyeing process of fibers that calls for the bleaching of the fibers in a bath containing urea peroxide as the major component, neutralizing the bath by $NaHSO_3$ after bleaching, and dyeing the fibers with the addition of dye to the same bath. Uehara (Japan ('782)) supra, reports a single bath bleaching and dyeing process of textiles, in which the textile is bleached in a bath containing bleaching agent(s), chiefly of peroxide(s), and the agent(s) are decomposed by adding reducing agent, chiefly of thio compounds, to the bath, followed by addition of dye(s) to the bath to effect dyeing. In the example given in the patent, Uehara explains that the bath is drained and replaced by a fresh bath after neutralization of peroxide(s) with reducing agent and then the dyeing is carried out according to conventional methods. Other dyebath bleaching processes that employ products available commercially are summarized in a recent review by Duffield supra.

SUMMARY

It is a first object of the present invention to provide bleaching greatly superior to that of prior art processes, said bleaching providing fibers of a surprising and unexpectedly high degree of whiteness, low degree of yellowness and low degree of fiber damage.

It is a second object of the present invention to provide processes which may provide oxidative and reductive bleaching and dyeing in a single bath, and thereby provide the advantages of: (a) avoiding the three or four step treatment processes normally required by conventional processes thereby simplifying the process; (b) reducing the amount of time required to provide effective bleaching and dyeing; (c) reducing the amount of equipment required to perform bleaching and dyeing; (d) reducing processing time as compared to conventional procedures; (e) reducing processing temperature, thereby making such processing more energy efficient; (f) eliminating the need for dye bath auxiliaries such as urea and sodium sulfate; and (g) reducing the amount of effluent produced, thereby reducing any adverse effect on the environment.

It is another object of the instant invention to utilize the surprising and unexpected step of employing by-products of the initial bleaching (such as urea, sodium sulfate) as dye assists during the dyeing step.

It is another object of the instant invention to produce fiber having much brighter and deeper pastel shades upon dyeing, due to better whiteness and less chemical damage (thereby allowing higher dye exhaustion and affinity) achieved by the sequential oxidative and reductive bleaching of the present invention.

Other objects and advantages of this invention will become readily apparent from the ensuing description.

The aforementioned objects and advantages are achieved by:

A first process of the present invention which comprises, contacting fibers with hydrogen peroxide under conditions which provide oxidative bleaching of said fibers to produce bleached fibers in contact with unspent hydrogen peroxide;

adding to said bleached fibers in contact with unspent hydrogen peroxide (from the previous step), a material selected from the group consisting of thiourea and substituted thiourea (such as 1,3-dimethyl-2-thiourea or 1,3-di-n-butyl-2-thiourea) which combines with hydrogen peroxide to form a reductive bleaching agent, in an amount sufficient to produce a reductive bleaching medium including excess reductive bleaching agent;

maintaining said bleached fibers in said reductive bleaching medium under conditions providing reductive bleaching of said bleached fibers, to produce bleached fibers in reductive bleaching medium including excess reductive bleaching agent;

adding to said bleached fibers in reductive bleaching medium including excess reductive bleaching agent, an oxidizing material in an amount at least sufficient to oxidize said excess reductive bleaching agent, to form bleached fibers in an inactivated medium; and combining said bleached fibers in said inactivated medium with a dye under conditions to provide dyeing of said bleached fibers.

A second process of the present invention which comprises, contacting fibers with hydrogen peroxide under conditions which provide oxidative bleaching of said fibers to produce bleached fibers in contact with unspent hydrogen peroxide;

adding to said bleached fibers in contact with unspent hydrogen peroxide (from the previous step), an inactivating material in an amount at least sufficient to inactivate all of said unspent hydrogen peroxide to form an inactivated medium;

subsequent to said inactivation of all said unspent hydrogen peroxide, reductively bleaching said bleached fibers by addition of an excess of reductive bleaching agent to said inactivated medium, to produce bleached fibers in a reductive bleaching medium including excess reductive bleaching agent;

adding to said bleached fibers in said reductive bleaching medium including excess reductive bleaching agent an oxidizing material in an amount at least sufficient to oxidize said excess reductive bleaching agent, to form bleached fibers in an inactivated medium; and combining said bleached fibers in said inactivated medium with a dye under conditions to provide dyeing of said bleached fibers.

DETAILED DESCRIPTION OF THE INVENTION

Figure 1:
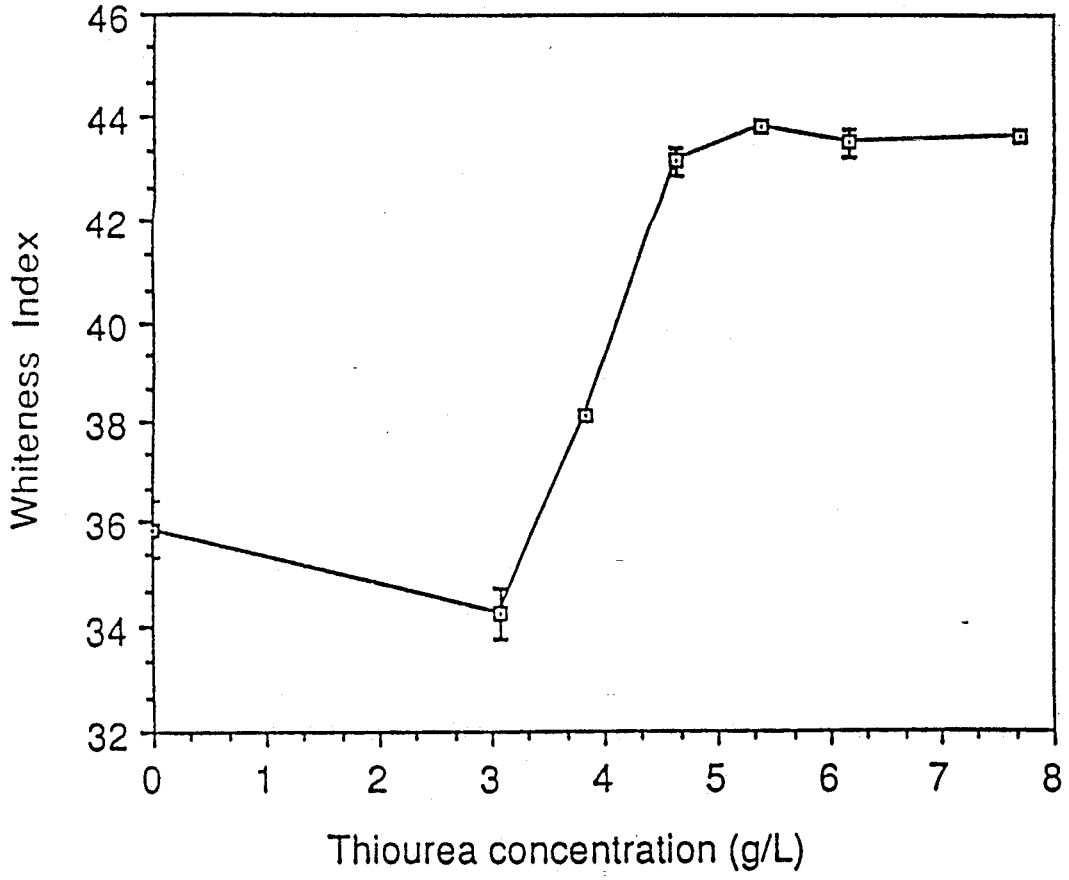
FIG. 1 is a line graph of Whiteness Index versus thiourea concentration, for a process of the present invention with in situ formation of a reductive bleaching substance using conditions referred to in example 1 and table I.

Both of the bleaching and dyeing processes of the present invention may be utilized to great advantage with any of a wide variety of fiber compositions, including animal hair fibers, plant fibers, synthetic fibers, and blends of two or more of the aforementioned, (notably, fibers consisting essentially of wool, fibers consisting of cotton, and blends of wool with other materials). Said fibers may be in any suitable form which permits bleaching and dyeing, including: loose fibers, yarns (twisted, woven, wrapped, etc.), fabric (e.g. woven, matted, felted), etc. It is also a great advantage of the present invention that the processes may be carried out over a wide range of temperatures e.g. about 40° C. to about 100° C. Both of the bleaching and dyeing processes of the present invention permit, either: (1) all steps to be carried out batch-wise in a single bath, or; (2) all steps to be carried out continuously using a continuous pad system ("padding" is a process well known in the art, and is for example defined on page 109 of *Textile Terms and Definitions,* Fifth Edition, published by Textile Institute, August 1963).

When the aforementioned first process of the present invention is carried out employing thiourea as the material which combines with hydrogen peroxide to form a reductive bleaching agent, it is preferred to: add the thiourea in a stoichiometric ratio to the unspent hydrogen peroxide of, at least about 1 to 4 i.e. at least one mole of thiourea for each 4 moles of unspent hydrogen peroxide (more preferably in a said ratio of, at least about 2 to 4 i.e. at least about 2 moles of thiourea for each 4 moles of unspent hydrogen peroxide, and most preferably in a said ratio of about 2 to 4 i.e. about 2 moles of thiourea for each 4 moles of unspent hydrogen peroxide), and; adjust the reductive bleaching medium to a pH of about 6 to about 9, more preferably about 6.5 to about 7.5. When thiourea is added, it reacts with residual hydrogen peroxide. The thiourea dioxide that is formed by this reaction hydrolyzes in solution to sulfinate anion and urea. Sulfinate anion is a strong reducing agent and effects reductive bleaching. At the end of the reductive bleaching stage, an oxidizing material (e.g. hydrogen peroxide) is added to oxidize all the reductive sulfur species in solution to the sulfate anion, which together with the urea serves subsequently as a dye assist. Once the temperature of the bath is reduced, dyes may be added to commence dyeing in the same bath. Also, in regard to the first process of the present invention, it is preferred to carry out the bleaching of fibers in the reductive bleaching medium for a time period of from about 5 to about 35 minutes.

In carrying out the aforementioned second process of the present invention, it is preferred to: utilize as the inactivating material, a material selected from the group consisting of:

(1) catalysts which catalyze decomposition of hydrogen peroxide, such as transition metals preferably used at a pH of from about 6 to about 10 (e.g. if necessary a suitable chemical is added to the bleached fibers in contact with unspent hydrogen peroxide, in order to bring the pH into the range of from about 6 to about 10). Optionally, after the transition metal(s) have completed deactivation of the unspent hydrogen peroxide, a chelating agent may be added in order to chelate excess transition metal ions (if any) prior to the reductive bleaching;

(2) enzymes which decompose hydrogen peroxide, preferably the pH of the bleached fibers in contact with unspent hydrogen peroxide is adjusted to be from about 3 to about 10 prior to adding the enzyme. For example, suitable enzymes include catalase (which preferably is used at a pH of from about 5 to about 8.5) and enzymes referred to in chapter 8 of *Hydrogen Peroxide*, W. C. Schumb et al editors, published by Reinhold Pub. Corp., New York, 1955.

(3) materials which react with hydrogen peroxide to render the hydrogen peroxide inactive, such as cerium (which may be provided in chemical combination with other materials, but which upon addition to the bleached fiber and unspent hydrogen peroxide makes cerium available for reaction with hydrogen peroxide) or quinones.

While any suitable reductive bleaching agent may be utilized in said second process, it is preferred to utilize a reductive bleaching agent selected from the group consisting of thiourea dioxide, sodium hydroxymethanesulfinate (sodium formaldehyde sulfoxylate), sodium hydrosulfite and sodium bisulfite.

EXAMPLES

The following examples are intended only to further illustrate the invention and are not intended to limit the scope of the invention which is defined by the claims.

In the following examples, bleaching of wool fabric was performed using an Ahiba Texomat (Ahiba Inc., Charlotte, N.C.) laboratory dyeing apparatus. Oxidation potential was monitored on a voltmeter using a Corning Platinum Redox Combination electrode (Fisher Scientific Co., Springfield, N.J.); pH was monitored on an E & K pH meter (E & K Scientific product, Saragota, Calif.) using a combination glass electrode (from either Cole-Palmer International, Chicago, Ill. or a Corning combination glass electrode from Fisher Scientific Co., Springfield, N.J.). All bleaching treatments were carried out at a liquor to wool ratio of 30 milliliters liquor:1 gram of fabric. Wool samples (10 g) were bleached in various bleach bath compositions and conditions.

Whiteness (ASTM; E-313) and Yellowness (ASTM; D-1925) Indices were measured with a Colorgard System 1000 tristimulus colorimeter (Pacific Scientific Co., Silver Spring, Md.). Sample illumination was by a quartz-halogen lamp at color temperature of 2854 degrees Kelvin with 360° circumferential illumination (CIE Source C, 1931 Standard Observer Illuminant) geometry that is 45° from the sample's normal direction, sample viewing being at 0°. The equations used in the Colorgard System for the calculations of Whiteness and Yellowness Indices are:

$$WI = 3.387Z - 3Y$$

$$YI = [100(1.277X - 1.06Z)]/Y$$

where; X, Y and Z are the measured tristimulus values; WI is the Whiteness Index, and YI is the Yellowness Index. The extent of degradation of the wool caused by bleaching was determined by measuring the loss in weight of the sample after immersion in 0.1M sodium hydroxide for 1 hour at 65±0.5° C. [I.W.T.O. Technical Committee Report, 1960, IWTO-4-60(E)]. Wet tensile strength measurements of wool flannel, bleached and treated under various conditions, were carried out according to the standard method as set forth in ASTM, 1981 Book of ASTM standards, Am. Soc. for Testing and Materials: Wood flannel fabric was cut into ten equal size strips of length 140 mm and width 13 mm, 5 oriented along the warp axis (18 yarns) and the other 5 along the weft axis (14 yarns). These samples were then soaked for 24 hours in an aqueous solution containing Triton X-100 (0.5 g/L). An Instron tensile testing machine (Instron Corp., Canton, Mass.) of gauge length 90 mm was used for the measurements of breaking load and elongation. The wetted-out samples were secured between the clamps and a constant rate of load was applied along the warp or weft directions until the fabric was broken.

A. Oxidative hydrogen peroxide bleaching followed by thiourea

One aspect of the present invention relates to the formation of a reductive substance in situ when thiourea is added to an oxidative hydrogen peroxide bleach bath adjusted to pH 4.5 to 7.0 and then allowed to hydrolyze under approximately neutral or slightly alkaline conditions (e.g. pH of about 6 to 9, preferably a pH of from about 6.5 to about 7.5). The optimum stoichiometric ratio of thiourea to hydrogen peroxide was found to be about 2 to 4. An exact amount of thiourea therefore may be calculated based on the amount of unspent hydrogen peroxide remaining after a bleaching process, and that amount of thiourea may be added to the bleach bath for maximum efficiency. In the examples a marked drop in pH (pH=2 to 3) and an increase in temperature (by 5°-7° C.) of solution were observed. When the pH of the solution was then adjusted to a pH of from about 6.5 to about 7.5, the oxidation potential (mV) of the solution changed markedly from a positive to a very negative value.

EXAMPLE 1

Bleaching experiments were done in stirred bleaching vessels immersed in a stirred thermostatic bath. The substrate was a wool flannel fabric (20.60-26.39 microns in diameter, 233 g/m$^2$) with black hair and yellow wool, kindly supplied by Forstmann and Co., Inc., Dublin, Ga. Wool flannel fabric was bleached in the alkaline hydrogen peroxide bleach bath for 1 hour at 60° C. This was then followed by addition of thiourea and the necessary pH adjustment to attain a reductive substance in situ for the reductive bleaching part of the process. The reductive bleaching was carried out for 25 minutes at the same temperature. The bleaching conditions and the results are shown in Table I and depicted graphically in FIG. 1.

TABLE I

The effect of thiourea concentration on the oxidative/reductive bleaching of wool flannel.[a]

| Thiourea (g/L) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) | Reduction potential (mV)[f] |
|---|---|---|---|---|---|---|---|---|
| Unbleached | 11.42 ± 0.45 | 23.71 ± 0.20 | 11.60 ± 0.43 | 35.62 ± 1.41 | 56.64 ± 1.92 | 24.72 ± 1.26 | 60.57 ± 2.79 | — |
| —[g] | 35.85 ± 0.54 | 12.38 ± 0.17 | 22.43 ± 1.09 | 35.18 ± 2.58 | 55.32 ± 2.44 | 27.87 ± 0.83 | 55.51 ± 1.72 | +201 |
| 3.07 | 34.24 ± 0.48 | 13.16 ± 0.26 | 24.48 ± 0.49 | — | — | — | — | +226 |
| 3.85 | 38.09 ± 0.07 | 11.49 ± 0.03 | — | — | — | — | — | −170 |
| 4.61 | 43.15 ± 0.28 | 9.55 ± 0.03 | 22.14 ± 0.69 | — | — | — | — | −663 |
| 5.38 | 43.83 ± 0.09 | 9.23 ± 0.04 | 23.53 ± 0.37 | 32.43 ± 1.06 | 55.13 ± 1.90 | 22.99 ± 0.63 | 51.25 ± 1.88 | −698 |
| 6.15 | 43.52 ± 0.26 | 9.17 ± 0.16 | 24.00 ± 0.24 | — | — | — | — | −692 |
| 7.69 | 43.62 ± 0.05 | 9.23 ± 0.08 | 24.44 ± 0.22 | 32.74 ± 1.73 | 53.58 ± 2.37 | 22.39 ± 1.59 | 50.48 ± 2.80 | −680 |
| 5.38[h] | 31.84 ± 0.40 | 14.51 ± 0.22 | — | 43.30 ± 0.78 | 57.46 ± 1.72 | 27.82 ± 0.58 | 53.26 ± 0.99 | −14 |
| 5.38[i] | 37.14 ± 0.42 | 12.11 ± 0.14 | — | — | — | — | — | −242 |

[a]Alkaline hydrogen peroxide bleaching, 60° C., 1 hr, followed by thiourea addition, pH adjustment with NaOH to pH 7.4-7.6 unless indicated, and continued bleaching, 60° C., 25 min.
[b]As per ASTM E-313; mean value ± standard deviation of 3 samples, each having 8 measurements.
[c]As per ASTM D-1925; mean value ± standard deviation of 3 samples, each having 8 measurements.
[d]As per IWTO-4-60; mean value ± standard deviation of 3 samples.
[e]As per ASTM D-1682-64; mean value ± standard deviation of 5 determination.
[f]Measured immediately after thiourea addition and pH adjustment.
[g]I.e., alkaline hydrogen peroxide bleaching for 1 hr 25 min with no pH adjustment at 1 hr.
[h]pH of the solution is not adjusted after the addition of thiourea (pH = 3.6).
[i]Solution was buffered (pH = 6.8) before thiourea addition so that the reaction is carried out under neutral conditions.

Below a certain thiourea configuration (FIG. 1), no improvement in whiteness of wool flannel fabric is observed, this being due to the fact that under these conditions, a reductive substance is not formed since there is not sufficient thiourea to react with all the residual hydrogen peroxide.

| Alkaline bleach bath composition | |
|---|---|
| Hydrogen peroxide (30% w/w) | 20.0 mL/L of liquor |
| Tetrasodium pyrophosphate decahydrate | 10.0 g/L of liquor |
| Triton X-100 | 1.0 g/L of liquor |
| Initial pH of bleach bath | 9.4 |
| pH after oxidative bleaching for 1 hr at 60° C. | 8.3 |

-continued

| Alkaline bleach bath composition | |
|---|---|
| Weight of wool flannel fabric | 10 g |
| Liquor to wool ratio | 30 milliliters of liquor:1 gram of wool |

Sufficient thiourea should be added to make certain that a reductive bleaching media is produced. Above a certain thiourea concentration, no further improvement of whiteness of wool flannel fabric is observed. It is also apparent from the results in Table I that the pH adjustment to 7–8 may be very advantageous for attaining a high negative oxidation potential and an improvement in the whiteness of wool flannel fabric. The pH may be adjusted to provide a suitable reduction potential so that an improvement in whiteness of the wool flannel fabric is achieved.

EXAMPLE 2

Figure 2:
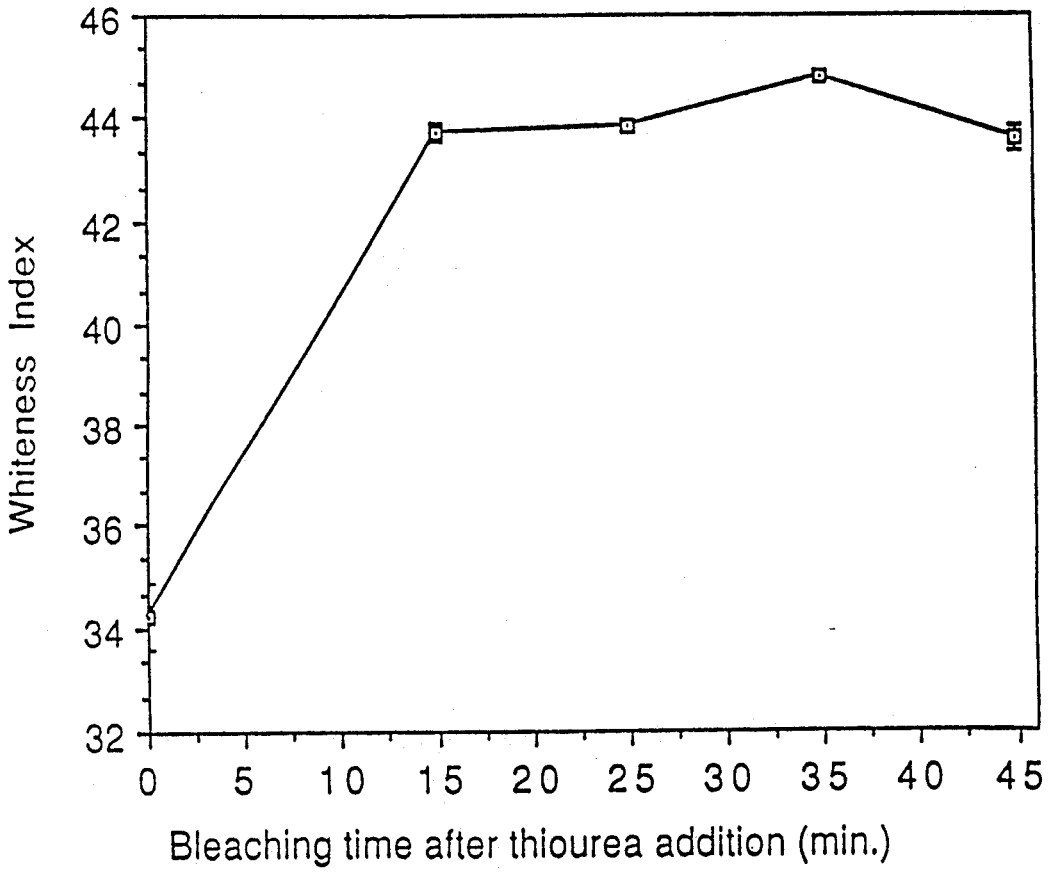
FIG. 2 is a line graph of Whiteness Index versus bleaching time after thiourea addition, for a process of the present invention (using conditions as described in example 2 and table II), showing the effect of varying bleaching time.

The bleaching solution composition and conditions were the same as those of Example 1 except that bleaching time after thiourea addition following alkaline hydrogen peroxide bleaching was varied. The results are shown in Table II and depicted graphically in FIG. 2.

TABLE II

The effect of thiourea bleaching time on the oxidative/reductive bleaching of wool flannel.[a]

| Bleaching time after thiourea addition (min.) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|
| —[f] | 34.23 ± 0.66 | 13.15 ± 0.31 | 19.04 ± 0.33 | 35.32 ± 1.02 | 55.88 ± 1.70 | 28.25 ± 0.75 | 56.51 ± 1.03 |
| 15 | 43.69 ± 0.18 | 9.18 ± 0.07 | 22.05 ± 0.26 | — | — | — | — |
| 25 | 43.83 ± 0.09 | 9.23 ± 0.04 | 23.53 ± 0.37 | 32.43 ± 1.06 | 55.13 ± 1.90 | 22.99 ± 0.63 | 51.25 ± 1.88 |
| 35 | 44.75 ± 0.07 | 8.87 ± 0.07 | — | 31.17 ± 1.70 | 54.68 ± 2.82 | 21.97 ± 0.99 | 52.44 ± 1.47 |
| 45 | 43.61 ± 0.24 | 9.31 ± 0.08 | 22.54 ± 0.72 | — | — | — | — |
| 25[g] | 44.42 ± 0.05 | 9.03 ± 0.01 | 20.63 ± 0.44 | 37.36 ± 1.56 | 58.77 ± 2.17 | 26.58 ± 1.36 | 58.04 ± 1.85 |
| 25[h] | 44.63 ± 0.63 | 8.93 ± 0.25 | 21.45 ± 0.67 | 36.29 ± 2.02 | 57.49 ± 3.41 | 23.57 ± 1.44 | 54.33 ± 3.78 |

[a]As per Table I except 5.38 g/L thiourea was used for various bleaching times.
[b]As per Table I.
[c]As per Table I.
[d]As per Table I.
[e]As per Table I.
[f]i.e., alkaline hydrogen peroxide bleaching for 60 min, with neither subsequent pH adjustment nor addition of thiourea.
[g]pH was adjusted to 7.1 (6 mL of 30% w/v $Na_2CO_3$ solution) after thiourea addition.
[h]pH was adjusted to 7.4 (7.5 g $NaHCO_3$) after thiourea addition.

The results in Table II show that the bleaching time after thiourea addition is not critical in the time range studied (15–45 min.). Bleaching times of 25–35 minutes after thiourea addition are preferred. Alkali solubility values are seen to be well below the critical value of 30 % as referred to in Ziegler, K. Textil-Praxis, 17, 376(1962). It is also shown in Table II that for the operating conditions of the instant example, that the pH of the bleach solution after thiourea addition may be raised to achieve a high negative oxidation potential; a pH of 7–8, obtained by weak alkalis such as sodium carbonate and bicarbonate, is as sufficient for achieving high bleaching efficiencies as higher values obtained with sodium hydroxide. The pH adjustment may be made with weak alkalis on large scale bleaching trials to avoid unwanted damage to wool that might occur from use of sodium hydroxide and uneven mixing.

EXAMPLE 3

Figure 3:
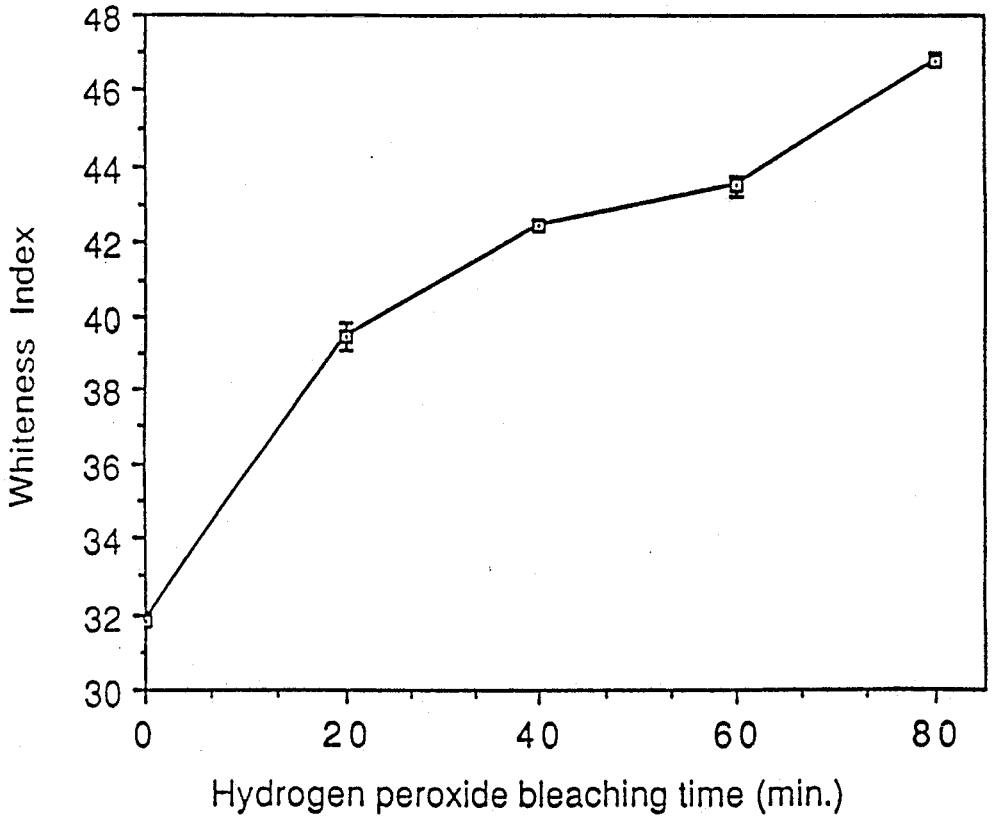
FIG. 3 is a line graph of Whiteness Index versus hydrogen peroxide bleaching time for conditions as referred to in example 3 and table III.

The bleaching solution composition and conditions were the same as those of Example 1 except the initial alkaline hydrogen peroxide bleaching time prior to thiourea addition was varied. The results, as shown in Table III and depicted graphically in FIG. 3, demonstrate that the longer the hydrogen peroxide bleaching part of the process, the whiter the bleached wool flannel fabric.

TABLE III

The effect of varying the hydrogen peroxide bleaching time on the oxidative/reductive bleaching of wool flannel.[a]

| Oxidative bleaching time (min.) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|
| 0[f] | 31.84 ± 0.19 | 13.89 ± 0.02 | — | — | — | — | — |
| 20 | 39.43 ± 0.38 | 10.97 ± 0.16 | — | — | — | — | — |
| 40 | 42.46 ± 0.15 | 9.69 ± 0.06 | 20.12 ± 0.34 | — | — | — | — |
| 60 | 43.52 ± 0.26 | 9.38 ± 0.04 | 24.00 ± 0.24 | 32.56 ± 1.51 | 54.90 ± 2.05 | 22.60 ± 1.20 | 50.95 ± 1.30 |
| 80 | 46.82 ± 0.16 | 8.04 ± 0.04 | 24.29 ± 0.13 | 30.91 ± 1.30 | 56.31 ± 1.35 | 19.20 ± 1.28 | 48.44 ± 1.22 |

[a]As per Table I except 6.15 g/L thiourea is used.
[b]As per Table I.
[c]As per Table I.
[d]As per Table I.
[e]As per Table I.
[f]Thiourea mixed with hydrogen peroxide and pH adjusted with no prior time for oxidative bleaching.

Here it must be emphasized that in the process of this example, that the wool flannel fabric to be bleached should first be given an oxidative peroxide bleaching prior to thiourea addition. This is simply demonstrated by the results given in Table III where the wool flannel fabric was not given an initial peroxide bleach. Hydrogen peroxide thiourea and all the other additives were mixed at the start of the bleaching treatment and bleaching was allowed to proceed for 20 minutes. The importance of initial hydrogen peroxide bleaching becomes more apparent when the Whiteness Index values of wool bleached for 60 minutes (with all chemicals mixed at the start i.e. as taught by Japan 51-64082) are compared with those of wool bleached for 65 minutes (40 minutes alkaline peroxide bleach followed by thiourea addition and bleaching for 25 minutes after pH adjustment). Although in both cases a high negative oxidation potential was attained, it seems that the initial oxidative hydrogen peroxide bleaching somehow modifies wool sufficiently so that a followup reductive bleaching further whitens wool effectively.

EXAMPLE 4

Figure 4:
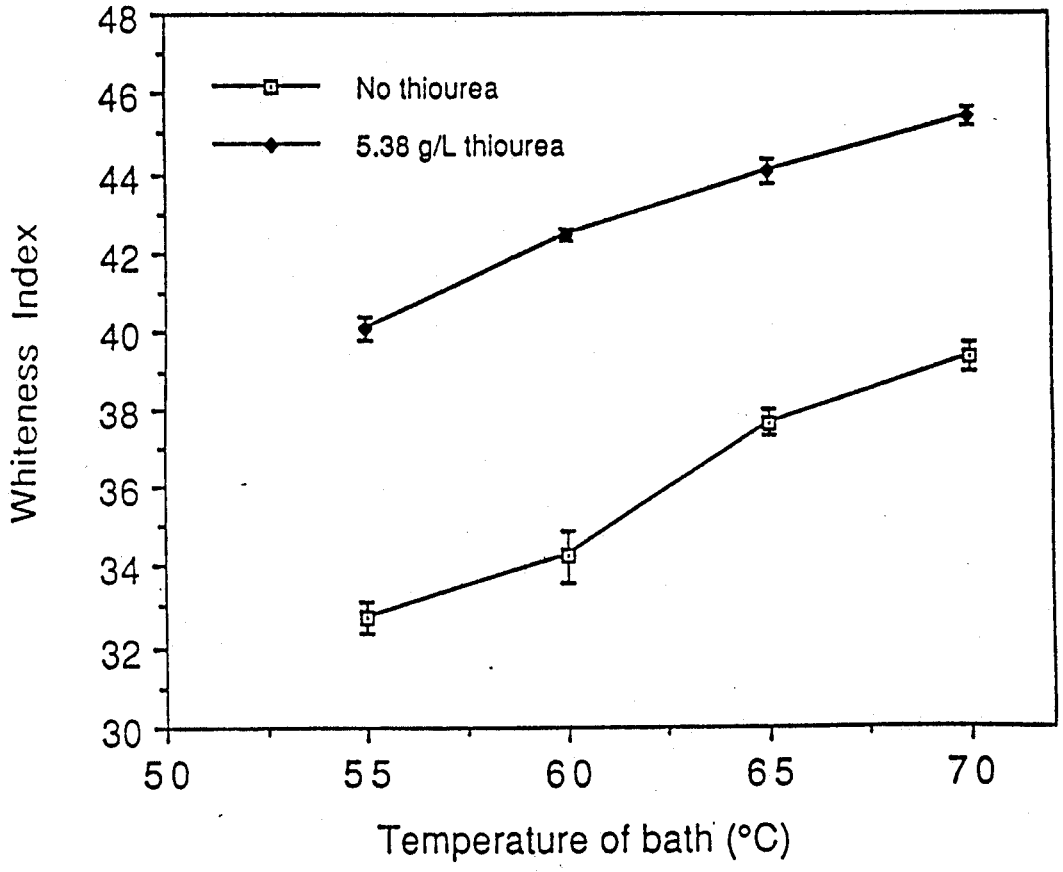
FIG. 4 is a line graph of Whiteness Index versus bath temperature: showing a comparison between conventional alkaline hydrogen peroxide bleaching and bleaching of the present invention: as referred to in example 4 and table IV.

The bleaching solution composition was the same as per Example 1. In the present example, a direct comparison of conventional alkaline hydrogen peroxide bleaching to that of the new invention (oxidative/reductive single-bath process) at different bleaching temperatures is made and the results are shown in Table IV and depicted graphically in FIG. 4.

TABLE IV

The effect of bleaching temperature on the oxidative/reductive bleaching of wool flannel.[a]

| Treatment temperature (°C.) | Thiourea addition | Total time of bleaching (min.) | Whiteness Index[b] | Yellowness Index[c] | Alkali Solubility (%)[d] |
|---|---|---|---|---|---|
| 55 | No | 65 | 32.76 ± 0.39 | 13.77 ± 0.16 | — |
| 55 | Yes | 65 | 40.11 ± 0.33 | 10.73 ± 0.15 | — |
| 60 | No | 65 | 34.23 ± 0.66 | 13.15 ± 0.31 | 19.04 ± 0.33 |
| 60 | Yes | 65 | 42.46 ± 0.15 | 9.69 ± 0.06 | 20.12 ± 0.34 |
| 60[e] | Yes | 60 | 33.89 ± 0.94 | 13.51 ± 0.35 | — |
| 65 | No | 65 | 37.63 ± 0.33 | 11.57 ± 0.13 | 28.23 ± 0.63 |
| 65 | Yes | 65 | 44.05 ± 0.31 | 9.00 ± 0.18 | 25.15 ± 0.52 |
| 70 | No | 65 | 39.36 ± 0.28 | 10.96 ± 0.11 | 32.61 ± 0.99 |
| 70 | Yes | 65 | 45.43 ± 0.23 | 8.46 ± 0.14 | 28.88 ± 0.37 |

[a]Alkaline hydrogen peroxide bleaching at different temperatures, 40 min., followed by thiourea addition (6.15 g/L; pH adjustment with NaOH to pH 7.4–7.6 only in the thiourea cases), and continued bleaching for 25 min.
[b]As per Table I.
[c]As per Table I.
[d]As per Table I.
[e]Thiourea mixed with hydrogen peroxide and pH adjusted with no prior time for oxidative bleaching.

TABLE V

The effect of thiourea on the oxidative/reductive bleaching of wool flannel.[a]

| Thiourea (g/L) | Total time of bleaching (min.) | Whiteness Index[b] | Yellowness Index[c] | Alkali Solubility (%)[d] | Warp[e] Breaking Load (N) | Warp[e] Elongation (%) | Weft[e] Breaking Load (N) | Weft[e] Elongation (%) |
|---|---|---|---|---|---|---|---|---|
| — | 65 | 29.12 ± 0.12 | 16.24 ± 0.30 | 28.49 ± 0.30 | 37.25 ± 2.04 | 66.15 ± 2.48 | 24.39 ± 0.47 | 59.33 ± 2.00 |
| 5.38 | 65 | 42.56 ± 0.29 | 10.13 ± 0.14 | 21.72 ± 0.84 | 27.97 ± 1.83 | 56.82 ± 3.11 | 17.99 ± 1.26 | 51.88 ± 2.84 |
| — | 85 | 29.26 ± 0.33 | 16.03 ± 0.12 | — | 34.06 ± 0.31 | 63.11 ± 2.32 | 26.33 ± 1.85 | 63.75 ± 4.48 |
| 5.38 | 85 | 43.60 ± 0.21 | 9.51 ± 0.28 | — | 24.53 ± 0.83 | 53.46 ± 3.18 | 19.72 ± 0.88 | 56.22 ± 1.63 |

[a]Acidic hydrogen peroxide bleaching (as per experimental) for 40 or 60 min at 80° C., followed, when indicated, by thiourea addition, (pH adjustment with NaOH to pH 7.4–7.6), and continued bleaching at 80° C. for 25 min.
[b]As per Table I.
[c]As per Table I.
[d]As per Table I.
[e]As per Table I.

It is noteworthy that the same level of whiteness is reached at a bleaching temperature of 55° C. with the hydrogen peroxide-thiourea bleaching system (oxidative/reductive) as at 70° C. with the hydrogen peroxide system alone. Furthermore the former process is less damaging to the wool, as evidenced by lower alkali solubilities.

EXAMPLE 5

EXAMPLE 5

Acidic bleach bath composition

| | |
|---|---|
| Hydrogen peroxide (30% w/w) | 20.0 mL/L of liquor |
| Prestogen NB-W | 3.43 g/L of liquor |
| Triton X-100 | 1.0 g/L of liquor |
| Initial pH of bleach bath | 5.7 |
| pH after oxidative bleaching for 1 hr. at 80° C. | 5.2 |
| Weight of wool flannel fabric | 10 g |
| Liquor to wool ratio | 30 milliliter liquor:1 gram |

-continued

EXAMPLE 5

Acidic bleach bath composition of fabric

Prestogen NB-W (BASF Chemicals Division, Charlotte, N.C.) is a mixture of organic acid salts in aqueous solution which activates hydrogen peroxide at mildly acid pH values by forming peroxy compounds.

In this example, we demonstrate the effectiveness of the hydrogen peroxide-thiourea system on the bleaching efficiency under acidic oxidative bleaching with hydrogen peroxide followed by thiourea. The results are shown in Table V.

It is seen from the results that the bleaching efficiency are markedly improved with the hydrogen peroxide-thiourea system as compared to an oxidative acidic hydrogen peroxide bleaching alone. The decrease in breaking load and elongation noted in Table V for acidic oxidative/reductive bleaching is not understood, but is inconsistent with the alkali solubility results.

B. Direct addition of reductive substance to a decomposed oxidative hydrogen peroxide bleach bath It is well known that typically only a small fraction of hydrogen peroxide is consumed or decomposed during an efficient and effective bleaching process. In a typical two step, two-bath oxidative/reductive process, the goods are first bleached oxidatively using hydrogen peroxide (alkaline or acidic). They are then removed from the first bath and bleached in the second bath with a reducing agent. This process is not only costly but also time-consuming, since both baths must be heated up to a suitable temperature.

The principle behind this aspect of the present invention is that the active surplus hydrogen peroxide remaining after an oxidative bleaching treatment may be successfully decomposed with no adverse effect on the fiber or subsequent chemical treatment, thus allowing a reductive substance to be added to the bath directly. This is particularly sound for a single-bath process, since the bath is already in the temperature range suitable for subsequent reductive bleaching. There are many inorganic catalysts (such as, transition metals, e.g. iron, copper, manganese, cobalt, etc.) and enzymes that will decompose hydrogen peroxide.

A typical set of conditions would be as follows:

| | |
|---|---|
| Hydrogen peroxide (30% w/w) | 20 mL/L of liquor |
| Tetrasodium pyrophosphate decahydrate | 10 g/L of liquor |
| Triton X-100 | 1 g/L of liquor |

Wool fabric (10 g) was bleached with the above solution at a liquor to goods ratio of 30 milliliter liquor:1 gram of wool for 60 minutes at 60° C. The pH of the bleach liquor was then adjusted to 8.8 and $CoSO_4$ (25 mg/L) was added to the bleach bath. Rapid evolution of oxygen was observed and the decomposition of hydrogen peroxide was complete within 10–15 minutes as the titration against acidified $KMnO_4$ showed. At this stage, a chelating agent such as nitrilotriacetic acid trisodium salt could be added to complex with the free Co ions and the pH of the solution could be adjusted to the desired value for the reductive bleaching part of the process.

The above is a specific set of typical conditions, but in general the conditions may be varied. It is found that hydrogen peroxide may be decomposed efficiently in the pH range 7.8–9.0 and temperature range 80°–60° C. with no adverse effect on wool. Reductive bleaching is either carried out under neutral or acidic conditions. Therefore, after the decomposition of hydrogen peroxide and the pH adjustment, the temperature of the bath may be increased to the desired temperature to obtain optimum bleaching yields.

EXAMPLE 6

Figure 5:
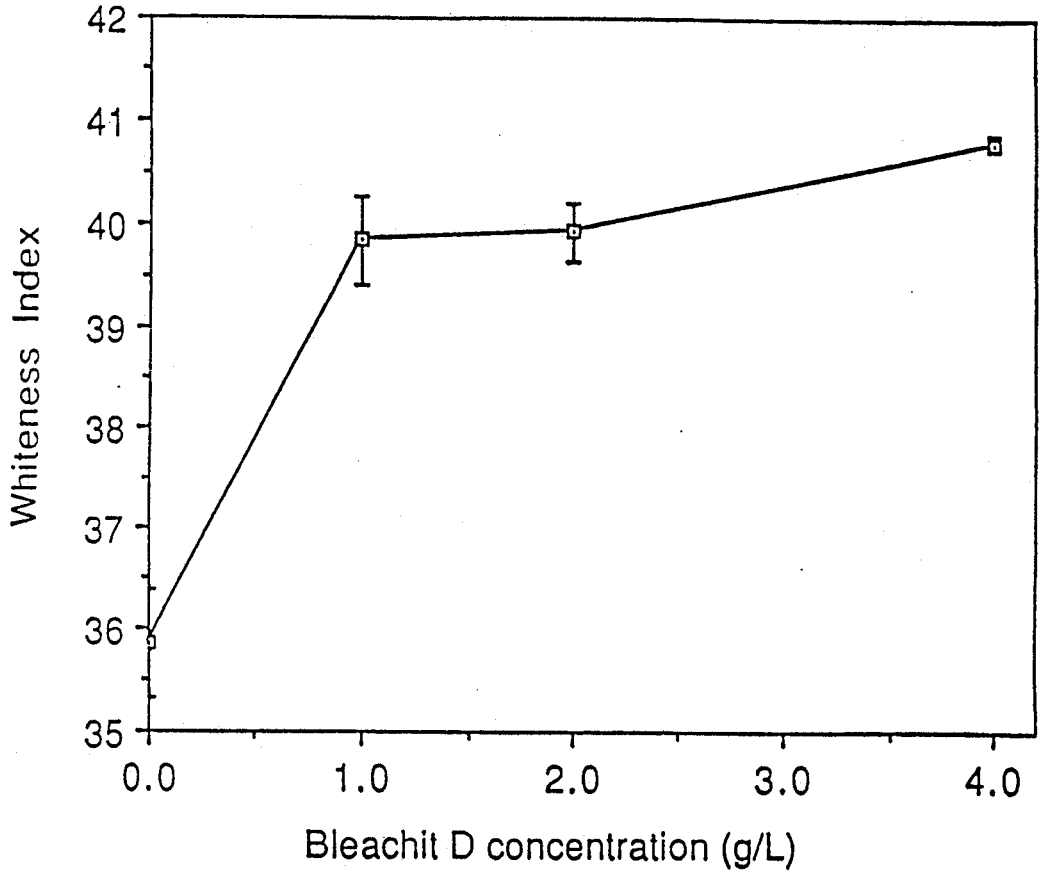
FIG 5 is a line graph of Whiteness Index versus Bleachit D concentration for a process of the present invention as referred to in example 6 and table VI.
Figure 6:
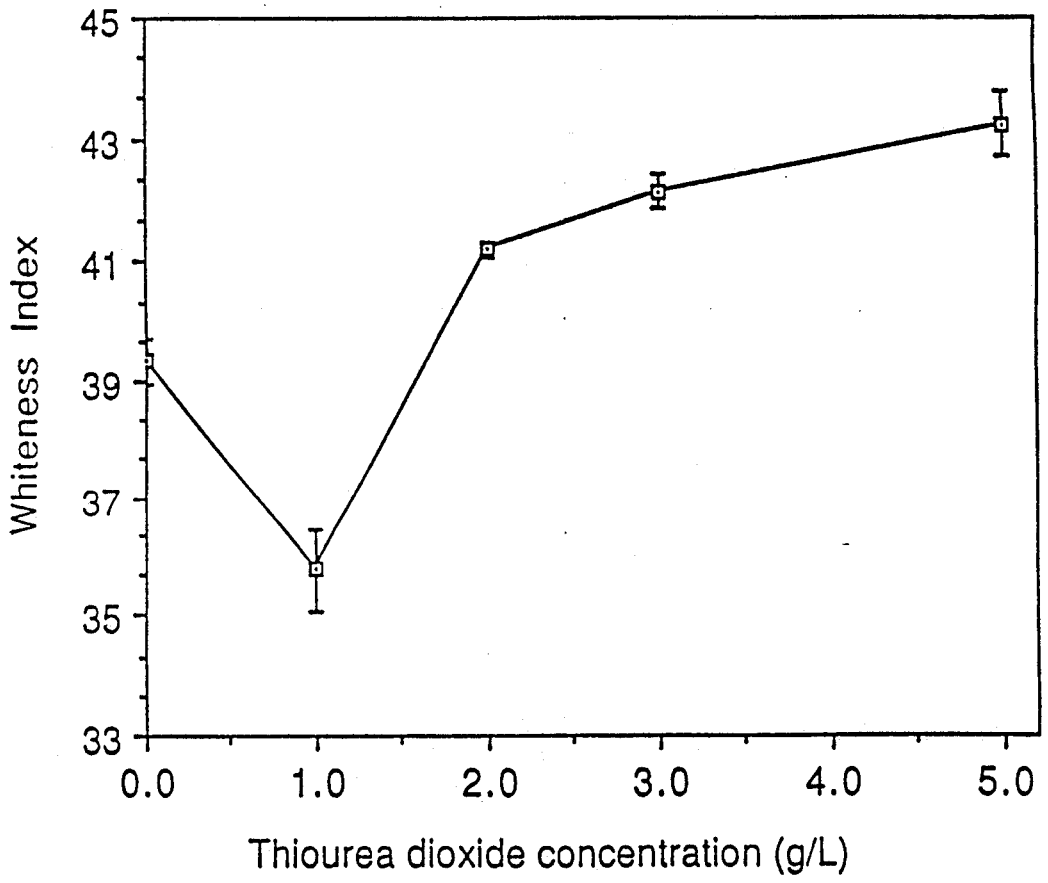
FIG. 6 is a line graph of Whiteness Index versus thiourea dioxide concentration for a process of the present invention as referred to in example 6 and table VI.

In this example the effect of reductive bleaching (sodium hydroxymethanesulfinate [Bleachit D (BASF Chemical Division, Charlotte, N.C.)] or thiourea dioxide) is demonstrated under various conditions as an aftertreatment following an oxidative alkaline hydrogen peroxide bleaching. The results of bleaching trials are shown in Table VI and depicted graphically in FIGS. 5 and 6.

TABLE VI

The effect of reductive agent after treatment (Bleachit D, thiourea dioxide) on the oxidative/reductive bleaching of wool flannel.[a]

| Bath temperature (°C.) | Hydrogen peroxide (mL/L) | Bleachit D (g/L) | Thiourea dioxide (g/L) | Whiteness Index[b] | Yellowness Index[c] | Alkali Solubility (%)[d] |
|---|---|---|---|---|---|---|
| 60 | 20[e] | — | — | 35.85 ± 0.54 | 12.38 ± 0.17 | 22.43 ± 1.09 |
| 60 | 20[f] | 1.0 | — | 39.84 ± 0.42 | 10.66 ± 0.21 | 24.58 ± 0.47 |
| 60 | 20[f] | 2.0 | — | 39.93 ± 0.27 | 10.58 ± 0.07 | — |
| 60 | 20[f] | 4.0 | — | 40.80 ± 0.07 | 10.60 ± 0.03 | 24.59 ± 0.69 |
| 70 | 20[e] | — | — | 39.33 ± 0.36 | 10.94 ± 0.17 | 30.73 ± 0.78 |
| 70 | 20[g] | — | 1.0 | 35.75 ± 0.66 | 12.51 ± 0.24 | 22.65 ± 0.67 |
| 70 | 20[g] | — | 2.0 | 41.21 ± 0.13 | 10.26 ± 0.19 | — |
| 70 | 20[g] | — | 3.0 | 42.14 ± 0.28 | 9.69 ± 0.08 | 22.51 ± 0.32 |
| 70 | 20[g] | — | 5.0 | 43.26 ± 0.52 | 9.24 ± 0.19 | — |

[a]As per experimental; residual hydrogen peroxide quenched using $CoSO_4$ prior to reductive bleaching.
[b]As per Table I.
[c]As per Table I.
[d]As per Table I.
[e]Alkaline hydrogen peroxide bleaching for 1 hour and 25 minutes, as per Table I, note g.
[f]As per e, but for 50 minutes, followed by peroxide decomposition with $CoSO_4$ for the next 10 minutes at pH 8.8 and finally reductive bleaching (Bleachit D, pH adjusted to 2.5) at the same temperature for 25 minutes.
[g]As per 'f' except for reductive bleaching agent (thiourea dioxide, pH adjusted to 6.5–7.0).

In the process of the instant example, the decomposition of residual hydrogen peroxide is essential; preliminary experiments showed that large amounts of reductive agents (thiourea dioxide, sodium hydroxymethanesulfinate) were needed to consume all the residual hydrogen peroxide before a high negative oxidation potential could be attained upon addition of the reductive agent. It should also be noted that thiourea dioxide, unlike sodium hydroxymethanesulfinate, does not produce a high negative oxidation potential under acidic conditions; therefore, with thiourea dioxide it is preferred to utilize a pH of about 6.5–7.0. For reasons of economy it is preferred that all residual hydrogen peroxide after oxidative bleaching be completely decomposed so that an addition of only a relatively small amount of reductive substance creates the reduction potential that is needed for the latter part of the process.

EXAMPLE 7

COMPARATIVE EXAMPLE

The purpose of this example is to show the increased effectiveness of the present invention as compared to the processes of German Patent DE 3433926 Al (Mar. 27, 1986) and Japanese Patent JP 51-64082 (Jun. 3, 1976). The German patent discloses a single-bath process whereby a reductive bleaching with thiourea dioxide precedes an oxidative hydrogen peroxide bleaching. In that patent, two processes—one with and one without thiourea dioxide—were compared and it was concluded that the process with thiourea dioxide was favorable to the one without. The optimum bleaching conditions were said to be a reductive bleaching with a buffer mixture (pH=7.8, 4 g/L) containing thiourea dioxide (0.36 g/L) for 20 minutes at 80° C. followed by a direct addition of hydrogen peroxide (20 mL/L of 35% w/w solution) and further bleaching for 60 minutes at the same temperature. The Japanese patent mentions a process whereby thiourea and hydrogen peroxide are mixed at the start of the bleaching process (i.e., no prior oxidative bleaching) and there is no prescribed pH adjustment. Optimum bleaching conditions were said to be 2.91 g/L hydrogen peroxide (30% w/w) and 2.0 g/L thiourea at 95° C. for 20 minutes.

All the above processes were repeated in the exact manner outlined in the patents and the results along with those of our invention are shown in Table VII.

TABLE VII

Comparison of different bleaching processes.

| Process Type[a] | Treatment temperature (°C.) | Hydrogen peroxide (g/L) | Thiourea (g/L) | Thiourea dioxide (g/L) | Bleachit D (g/L) | Whiteness Index[b] | Yellowness Index[c] | Alkali Solubility (%)[d] |
|---|---|---|---|---|---|---|---|---|
| A | 60 | 20 | 5.38 | — | — | 43.83 ± 0.09 | 9.23 ± 0.04 | 23.53 ± 0.37 |
| B | 80 | 20 | 5.38 | — | — | 42.56 ± 0.29 | 9.51 ± 0.28 | 21.72 ± 0.84 |
| C | 80 | 20 | — | 0.36 | — | 35.31 ± 0.07 | 13.29 ± 0.02 | 27.40 ± 0.64 |
| C | 80 | 20 | — | — | — | 32.59 ± 0.21 | 14.36 ± 0.07 | — |
| D | 95 | 2.91 | 2.0 | — | — | 20.33 ± 0.50 | 18.87 ± 0.15 | — |
| E | 60 | 20 | — | — | 4.0 | 40.80 ± 0.07 | 10.60 ± 0.03 | 24.59 ± 0.69 |
| F | 70 | 20 | — | 5.0 | — | 43.26 ± 0.52 | 9.24 ± 0.19 | — |

[a]A (Our Process): Alkaline hydrogen peroxide bleaching followed by thiourea, as per Table I, note a;
B (Our Process): acidic hydrogen peroxide bleaching followed by thiourea, as per Table V, note a;
C (German Patent): Reductive bleaching with thiourea dioxide at pH 7.8 for 25 min, followed by hydrogen peroxide bleaching for 60 min,;
D (Japanese Patent); Hydrogen peroxide and thiourea mixed at start of bleaching process with no pH adjustment;
E (Our Process): As per Table VI, note f;
F (Our Process): As per Table VI, note g.
[b]As per Table I.
[c]As per Table I.
[d]As per Table I.

It is clearly seen that the present invention processes (A, B, E, F) give more effective bleaching (i.e. higher Whiteness Index, lower Yellowness Index and lower alkali solubility) than either of the other processes (C or D). Process type C (Table VII; reductive/oxidative) with thiourea dioxide is a near reverse of the present invention processes A, B, E and F (oxidative/reductive). One would therefore expect similar results. The differences that were observed must be a function of the process sequence, since high negative oxidation potentials were observed in all these processes. One may therefore conclude from this that in a single-bath bleaching process, an oxidative hydrogen peroxide bleaching must be carried out first, and only then followed by a reductive bleach.

EXAMPLE 8

Wool samples, each weighing 10 grams (g), that have been bleached differently were compared for their dyeing behavior using Telon Fast Blue RLW (Mobay Corporation, Pittsburgh, Pa.).

Figure 7:
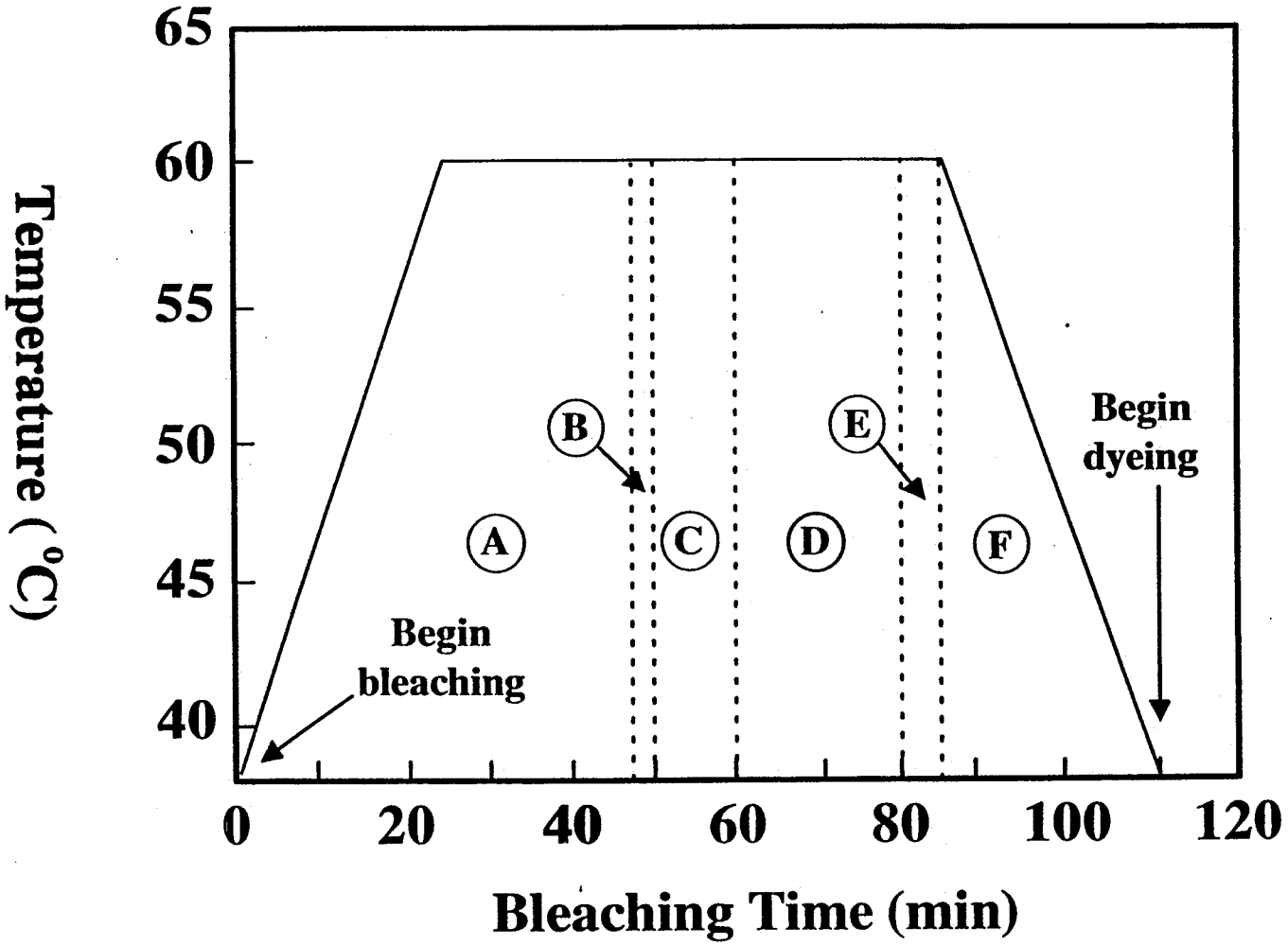
FIG. 7 is a graph of temperature vs. time for various phases (steps) of single-bath sequential oxidative/reductive bleaching of wool (up to the dyeing stage).

Sample 1. This sample is bleached according to the sequence of stages outlined in FIG. 7 for sequential bleaching and dyeing in a single bath.

Stage A: Alkaline oxidative bleaching with $H_2O_2$ (8.0 grams per liter (g/L); 30% w/w), tetrasodium pyrophosphate decahdrate (2.0 g/L) and Avolan UL-75 (0.5% on weight fiber, (owf)). The pH during bleaching is kept at 8.0–8.5. Initial temperature was 38° C., which is allowed to rise over 20 minutes to 60° C., then maintained at 60° C. for 28 minutes.

Stage B: Acidification with acetic acid to pH 5.0–5.5 over the next 2 minutes.

Stage C: Thiourea (1.67 g/L) is added to react with residual hydrogen peroxide in the bath during 10 minutes at 60° C.

Stage D: Aqueous ammonia is added quickly to adjust pH to 6.8–7.2 for reductive bleaching which then continues for 20 minutes at 60° C.

Stage E: Acidification (5 minutes) with acetic acid to pH 4.5–5.0 for the subsequent dyeing.

Stage F: Sufficient amount of hydrogen peroxide is added to inactivate the residual reductive medium to prepare the same bath for dyeing. The bath temperature is allowed to drop to 38° C. for subsequent dyeing. Telon Fast Blue RLW (0.6% owf) is then added directly to the bath. The pH during dyeing is according to the dye manufacturer's specifications, but no sodium sulfate (Glauber's salt) is added and the temperature limit is set to 80° C.

Sample 2. This sample is bleached for 85 minutes with alkaline oxidative bleaching with the bleach composition used in stage A above and then rinsed, acid soured and dried for subsequent dyeing according to the dye manufacturer's specifications, but with maximum temperature set to 80° C. The bath contained dye levelling agents, Avolan UL-75 (Mobay Corp., Pittsburgh, Pa., 0.5% owf) and Glauber's salt (10% owf). Avolan UL-75 has a dual role in the single bath bleaching and dyeing process. It acts as an amphoteric wetting agent for the bleaching part of the process and it then is carried over to the dyeing part of the process where it acts as a dye levelling agent.

Figure 8:
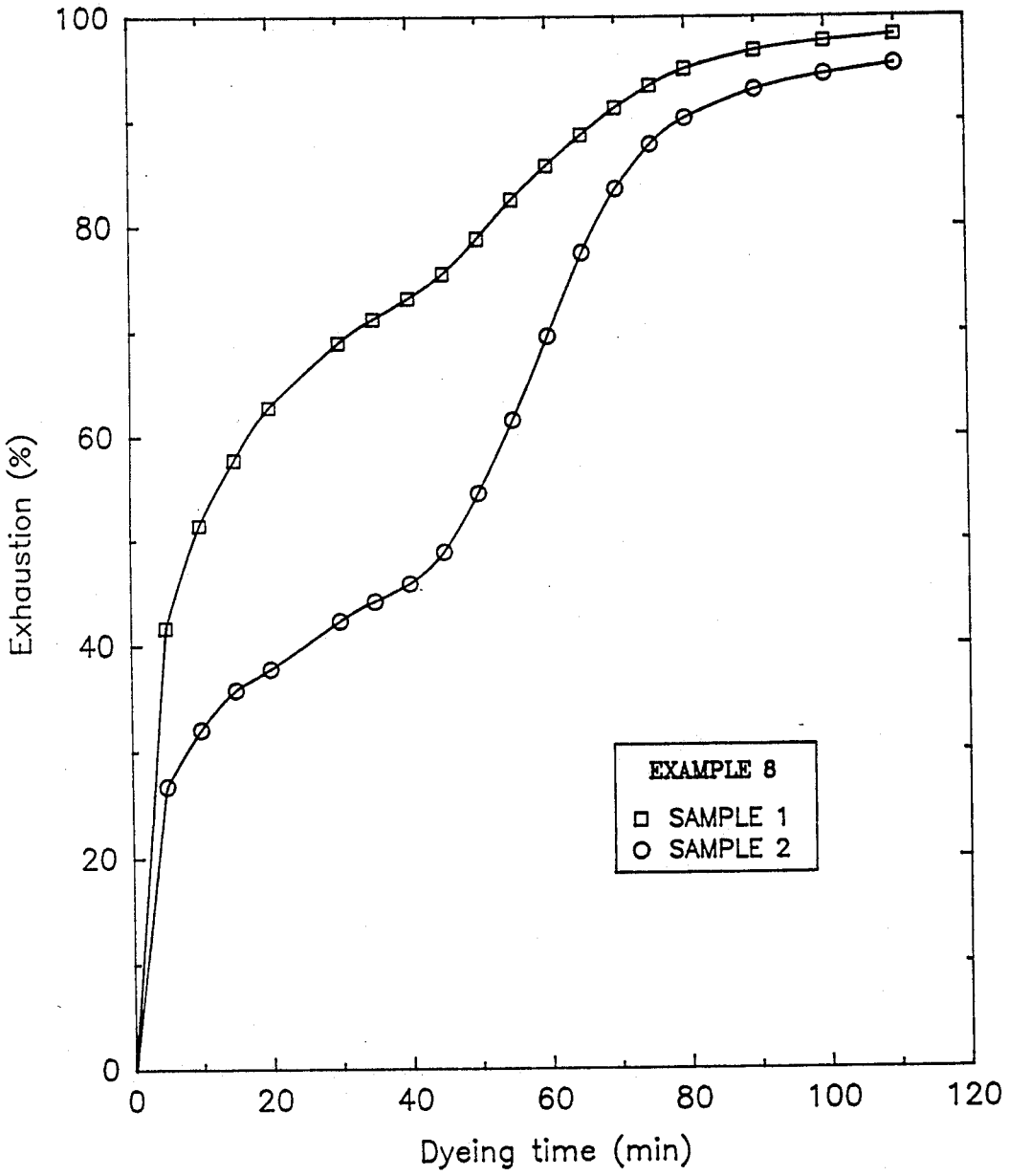
FIG. 8 is a graph of dye exhaustion (%) vs. dyeing time (in minutes) for dyeing of samples 1 and 2 as described in example 8.

Dye exhaustion vs. time profiles are shown in FIG. 8.

EXAMPLE 9

Two wool samples (i.e. samples 3 and 4) were treated in the same manner as samples 1 and 2 (respectively) of example 8, except that Isolan Red S-RL dyestuff (Mobay Corp., Pittsburgh, Pa., 0.3% owf) was used. Maximum temperature during dyeing was set at 90° C.

Figure 9:
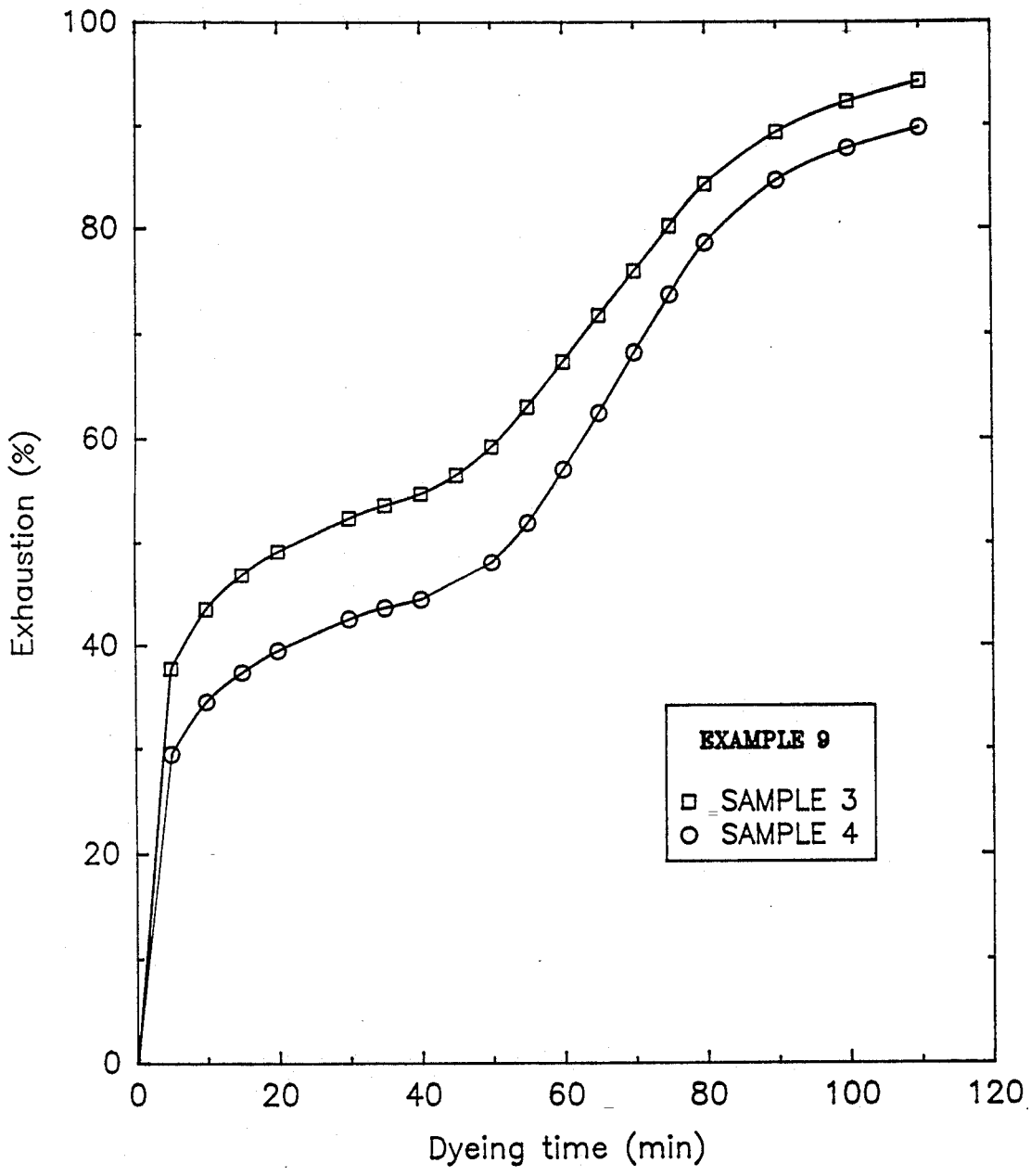
FIG. 9 is a graph of dye exhaustion (%) vs. dyeing time (in minutes) for dyeing of samples 3 and 4 as described in example 9.

Dye exhaustion vs. time profiles are shown in FIG. 9.

EXAMPLE 10

Two wool samples (i.e. samples 5 and 6) were treated in the same manner as samples 1 and 2 (respectively) of example 8, except that Lanaset Violet B dyestuff (Ciba-Geigy Corp., Greensboro, N.C., 0.3% owf) was used. Maximum temperature during dyeing was set at 85° C.

Figure 10:
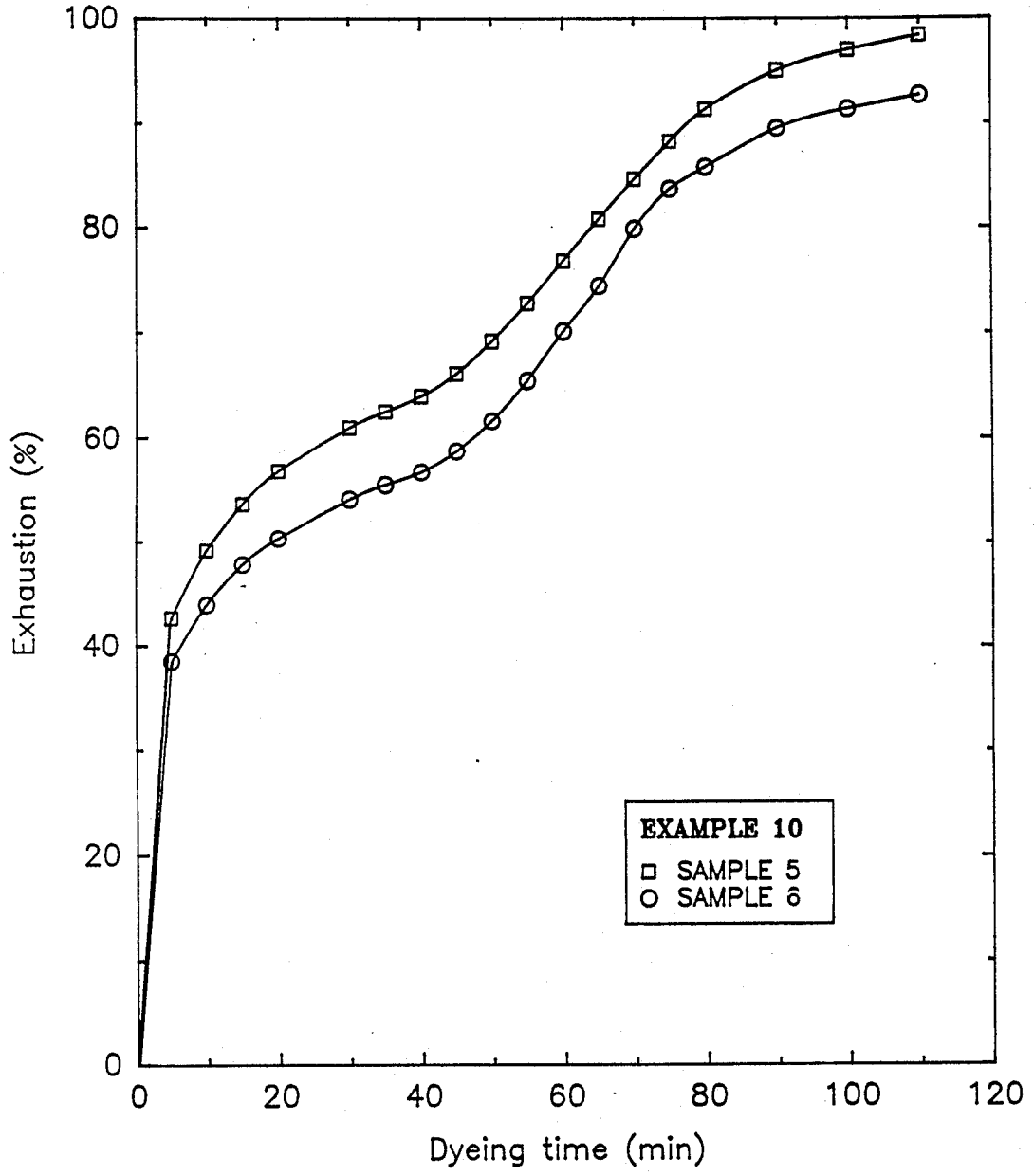
FIG. 10 is a graph of dye exhaustion (%) vs. dyeing time (in minutes) for dyeing of samples 5 and 6 as described in example 10.

Dye exhaustion vs. time profiles are shown in FIG. 10.

The results produced according to the examples 8–10 in the present invention point to a more uniformly dyed product which has a heavier and brighter depth of shade than those of a conventionally bleached and then dyed product in a separate bath. FIGS. 8–10 show the uptake of dyes by wool from a dye bath for a particular dye and concentration. The product produced according to the present invention has a higher dye uptake at a given time, temperature and dye concentration than that produced by goods that have been conventionally bleached and then dyed in separate baths.

The foregoing examples and detailed descriptions are given merely for purposes of illustration. Modifications and variations may be made therein without departing from the spirit and scope of the invention.

We claim:

1. A process for oxidative and reductive bleaching of fibers selected from the group consisting of animal hair fibers, plant fibers, synthetic fibers, and blends of two or more of said fibers; comprising:

contacting fibers with hydrogen peroxide under conditions which provide oxidative bleaching of said fibers to produce bleached fibers in contact with unspent hydrogen peroxide;

adding to said bleached fibers in contact with unspent hydrogen peroxide, a material selected from the group consisting of thiourea and substituted thiourea which combines with hydrogen peroxide to form a reductive bleaching agent, in an amount sufficient to produce a reductive bleaching agent;

maintaining said bleached fibers in said reductive bleaching medium under conditions providing reductive bleaching of said bleached fibers, to produce bleached fibers in reductive bleaching medium including excess reductive bleaching agent;

adding to said bleached fibers in reductive bleaching medium including excess reductive bleaching agent, an oxidizing material in an amount at least sufficient to oxidize said excess reductive bleaching agent, to form bleached fibers in an inactivated medium; and combining said bleached fibers in said inactivated medium with a dye under conditions to provide dyeing of said bleached fibers.

2. The process of claim 1 wherein said material is thiourea added in a stoichiometric ratio of, at least about to 4, to said unspent hydrogen peroxide, and said reductive bleaching medium is adjusted to a pH of about 6 to about 9.

3. The process of claim 2 wherein said thiourea is added in a stoichiometric ratio of, at least about 2 to 4, to said unspent hydrogen peroxide.

4. The process of claim 3 wherein said thiourea is added in a stoichiometric ratio of, about 2 to 4, to said unspent hydrogen peroxide.

5. The process of claim 2 wherein said reductive bleaching medium is adjusted to a pH of about 6.5 to about 7.5.

6. The process of claim 1 wherein, said step of maintaining said bleached fibers in said reductive bleaching medium, is carried out for a time period of from about 5 to about 35 minutes.

7. A process for oxidative and reductive bleaching of fibers selected from the group consisting of animal hair fibers, plant fibers, synthetic fibers, and blends of two or more of said fibers; comprising:

contacting fibers with hydrogen peroxide under conditions which provide oxidative bleaching of said fibers to produce bleached fibers in contact with unspent hydrogen peroxide;

adding to said bleached fibers in contact with unspent hydrogen peroxide, an inactivating material in an amount at least sufficient to inactivate all of said unspent hydrogen peroxide to form an inactivated medium;

subsequent to said inactivation of all said unspent hydrogen peroxide, reductively bleaching said bleached fibers by addition of an excess of reductive bleaching agent to said inactivated medium, to produce bleached fibers in a reductive bleaching medium including excess reductive bleaching agent;

adding to said bleached fibers in said reductive bleaching medium including excess reductive bleaching agent an oxidizing material in an amount at least sufficient to oxidize said excess reductive bleaching agent, to form bleached fibers in an inactivated medium; and combining said bleached fibers in said inactivated medium with a dye under conditions to provide dyeing of said bleached fibers.

8. The process of claim 7 wherein, said inactivating material is selected from the group consisting of: catalysts which catalyze decomposition of hydrogen peroxide, enzymes which decompose hydrogen peroxide, and materials which react with hydrogen peroxide to render said hydrogen peroxide inactive.

9. The process of claim 8 wherein, said inactivating material is a transition metal and the pH of said bleached fibers in contact with unspent hydrogen peroxide is adjusted to be from about 6 to about 10 prior to adding said transition metal.

10. The process of claim 9 further including the step of chelating excess metal ions by adding a chelating agent to said inactivated medium prior to said reductive bleaching.

11. The process of claim 8 wherein said inactivating material is an enzyme and the pH of said bleached fibers in contact with unspent hydrogen peroxide is adjusted to be from about 3 to about 10 prior to adding said enzyme.

12. The process of claim 11 wherein said enzyme is catalase and said pH is adjusted from about 5 to about 8.5.

13. The process of claim 8 wherein said inactivating material is a material which reacts with hydrogen peroxide to render said hydrogen peroxide inactive, selected from the group consisting of cerium and quinone.

14. The process of claim 7 wherein said reductive bleaching agent is selected from the group consisting of thiourea dioxide, sodium hydroxymethanesulfinate, sodium hydrosulfite and sodium bisulfite.

15. The process of claim 1 or 7 wherein all steps are carried out batch-wise in a single bath.

16. The process of either claim 1 or 7 wherein all steps are carried out continuously using a continuous padding system.

17. The process of either claim 1 or 7 wherein said fibers are in a form selected from the group consisting of loose fiber, yarn and fabric.

18. The process of claim 1 or 7 wherein said fibers are a material selected from the group consisting of wool, wool blends, and cotton.

19. The process of either claim 1 or 7 wherein all steps are carried out at temperatures between about 40° C. and about 100° C.

20. A bleached and dyed fiber produced by the process of either claim 1 or 7.

* * * * *